US009371113B2

(12) United States Patent
Eriksson

(10) Patent No.: US 9,371,113 B2
(45) Date of Patent: Jun. 21, 2016

(54) TOW LINE CONTROLLING DEVICE AND METHOD OF CONTROLLING SAME

(71) Applicant: National Oilwell Varco Norway AS, Kristiansand S (NO)

(72) Inventor: Hans Anders Eriksson, Lillesand (NO)

(73) Assignee: NATIONAL OILWELL VARCO NORWAY AS, Kristiansand S (NO)

( * ) Notice: Subject to any disclaimer, the term of this patent is extended or adjusted under 35 U.S.C. 154(b) by 0 days.

(21) Appl. No.: 14/398,913

(22) PCT Filed: Apr. 29, 2013

(86) PCT No.: PCT/NO2013/050078
§ 371 (c)(1),
(2) Date: Nov. 4, 2014

(87) PCT Pub. No.: WO2013/165257
PCT Pub. Date: Nov. 7, 2013

(65) Prior Publication Data

US 2015/0114277 A1 Apr. 30, 2015

(30) Foreign Application Priority Data

May 4, 2012 (NO) ..... 20120531

(51) Int. Cl.
*B63B 21/08* (2006.01)
*B63B 21/56* (2006.01)
*B63B 21/18* (2006.01)
*B66D 1/36* (2006.01)

(52) U.S. Cl.
CPC ..... *B63B 21/56* (2013.01); *B63B 21/18* (2013.01); *B66D 1/36* (2013.01)

(58) Field of Classification Search
CPC ..... B63B 21/18; B63B 21/56
USPC ..... 114/199
See application file for complete search history.

(56) References Cited

U.S. PATENT DOCUMENTS

| | | | | |
|---|---|---|---|---|
| 4,423,697 | A | 1/1984 | Royset | |
| 4,458,631 | A | 7/1984 | Hystad | |
| 6,446,568 | B1 | 9/2002 | Hystad | |
| 7,367,278 | B2 * | 5/2008 | Tande | B63B 21/04 114/199 |

FOREIGN PATENT DOCUMENTS

| | | | |
|---|---|---|---|
| WO | 2008/153411 | A1 | 12/2008 |
| WO | 2010/024684 | A1 | 3/2010 |
| WO | 2011/062504 | A1 | 5/2011 |

OTHER PUBLICATIONS

PCT/NO2013/050078 International Search Report and Written Opinion dated Sep. 16, 2013 (11 p.).

* cited by examiner

*Primary Examiner* — Stephen Avila
(74) *Attorney, Agent, or Firm* — Conley Rose, P.C.

(57) ABSTRACT

A tow line controlling device and a method of operation of a tow line controlling device in which the tow line controlling device is positioned in a deck of a vessel. The tow line controlling device includes at least two vertical tow pins that are movable between a passive position and at least one active position, and includes a gap between two of the tow pins, and the gap is spanned by a bridge formed by the two tow pins at least when the tow pins are in one of their active positions. The tow line controlling device also includes a lower stopper that is movable between a passive position and at least one active position and is positioned between two of the tow pins.

27 Claims, 8 Drawing Sheets

III-III

TOW LINE CONTROLLING DEVICE AND METHOD OF CONTROLLING SAME

CROSS-REFERENCE TO RELATED APPLICATIONS

This application is a 35 U.S.C. §371 national stage application of PCT/NO2013/050078 filed Apr. 29, 2013 and entitled "A Tow Line Controlling Device and Method of Controlling Same," which claims priority to Norwegian Application No. 20120531 filed May 4, 2012 and entitled "A Tow Line Controlling Device and Method of Controlling Same," both of which are hereby incorporated herein by reference in their entirety for all purposes.

STATEMENT REGARDING FEDERALLY SPONSORED RESEARCH OR DEVELOPMENT

Not applicable.

BACKGROUND

1. Field of the Disclosure

This disclosure relates generally to devices and methods for handling tow lines extending between vessels that operate in water. More particularly, this disclosure relates to an apparatus, system, and method for grasping and releasing a tow line on a vessel.

2. Background to the Disclosure

A tow line controlling device may be referred to also as a towbox, shark jaws and tow pins. The device is typically used to steer, control and lock a tow line from a tug ship. It is normally located close to the stern on the ship that is to be moved by the tug ship. One or two devices are used for each ship, and one prior art device includes two tow pins and one shark jaw. According to prior art, the tow pins control and steer the tow line, and the shark jaw stops and lock items on the tow line such as chain, shackles, or sockets. The shark jaw and tow pins are placed in line, with the shark jaw in front of the pair of tow pins. The tow pins and shark jaw do not interfere with each other.

Recognized regulation for ships demands that the shark jaw be capable of releasing the load from the tow line relatively quickly, for example in a few seconds, facilitating an "emergency release." This is traditionally solved by either pushing chain up from the shark jaw or pulling the shark jaw down. During both these methods, the chain is sheared towards the shark jaw. The shark jaw normally opens upwards.

The object of the disclosure is to remedy or reduce at least one of the disadvantages of the prior art by virtue of the features disclosed in the description below and in the subsequent claims.

BRIEF SUMMARY OF THE DISCLOSURE

In an exemplary embodiment, there is provided a tow line controlling device that is positioned in a deck of a vessel where the tow line controlling device includes at least two tow pins that are movable between a passive position and at least one active position, and where a gap between two of the tow pins is spanned by a bridge at least when the tow pins are in one of their active positions, wherein a lower stopper, that is movable between a passive position and at least one active position, is positioned between two of the tow pins.

In another exemplary embodiment, there is provided a method for operation of a tow line controlling device that is positioned in a deck of a vessel, and wherein the tow line controlling device includes at least two tow pins that are movable between a passive position and at least one active position, and wherein a gap between two of the tow pins is spanned by a bridge at least when the tow pins are in one of their active positions, wherein the method includes positioning a lower stopper, that is movable between a passive position and at least one active position, between two of the tow pins.

BRIEF DESCRIPTION OF THE DRAWINGS

Exemplary embodiments of a tow line controlling device are explained in reference to the enclosed drawings, where.

DETAILED DESCRIPTION OF THE DISCLOSED EMBODIMENTS

This disclosure presents embodiments of a tow line controlling device. In an embodiment, a tow line controlling device is positioned in a deck of a vessel, and the tow line controlling device includes at least two tow pins that are movable between a passive position and at least one active position. A gap between two of the tow pins is spanned by a bridge at least when the tow pins are in one of their active positions. This disclosure also provides a method for operation of a tow pin controlling device.

Throughout the specification, including in the claims, the terms "upper" and "lower" refer to components in their operational positions.

On the drawings the reference number 1 denotes a tow line controlling device that in one embodiment includes a cage 2 having a top surface that forms part of a deck 4 of a stern portion of a vessel not shown.

Figure 1:
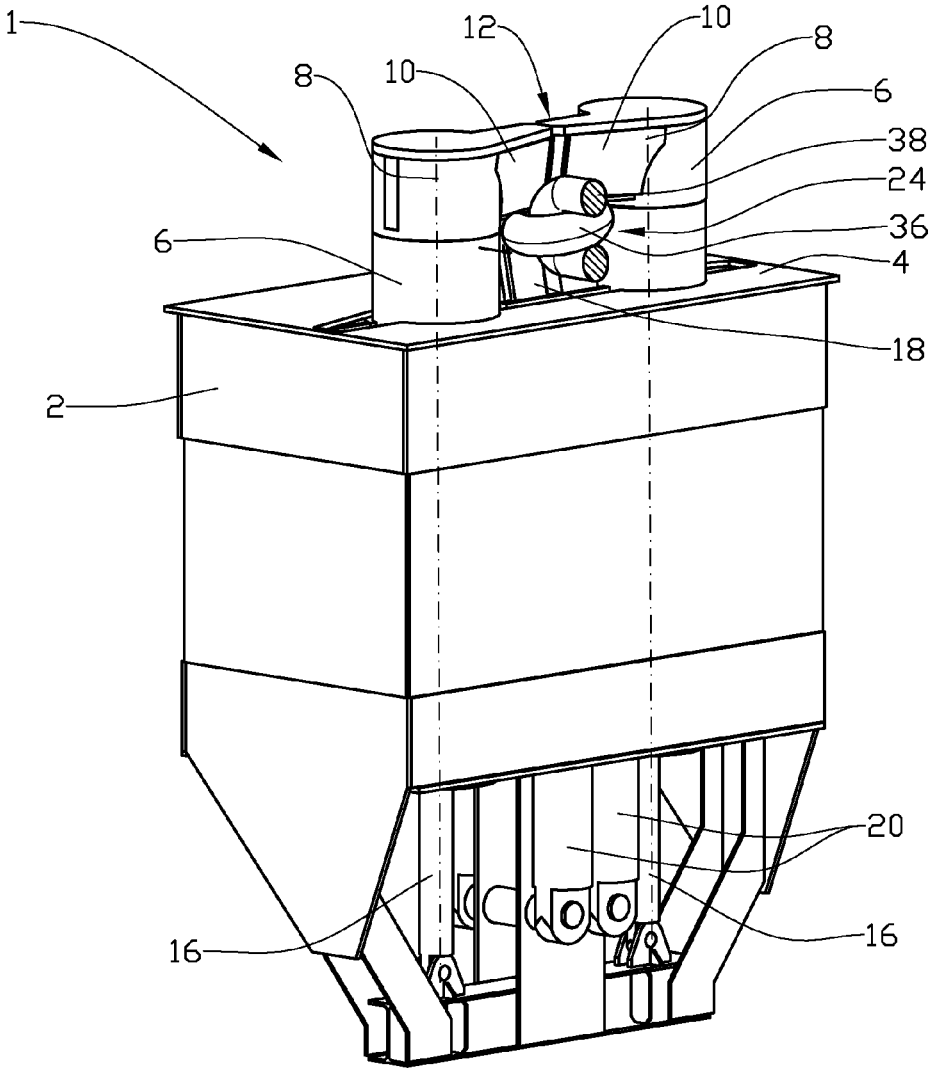
FIG. 1 shows a tow line controlling device according to the disclosure in a perspective view in accordance with principles described herein.
Figure 2:
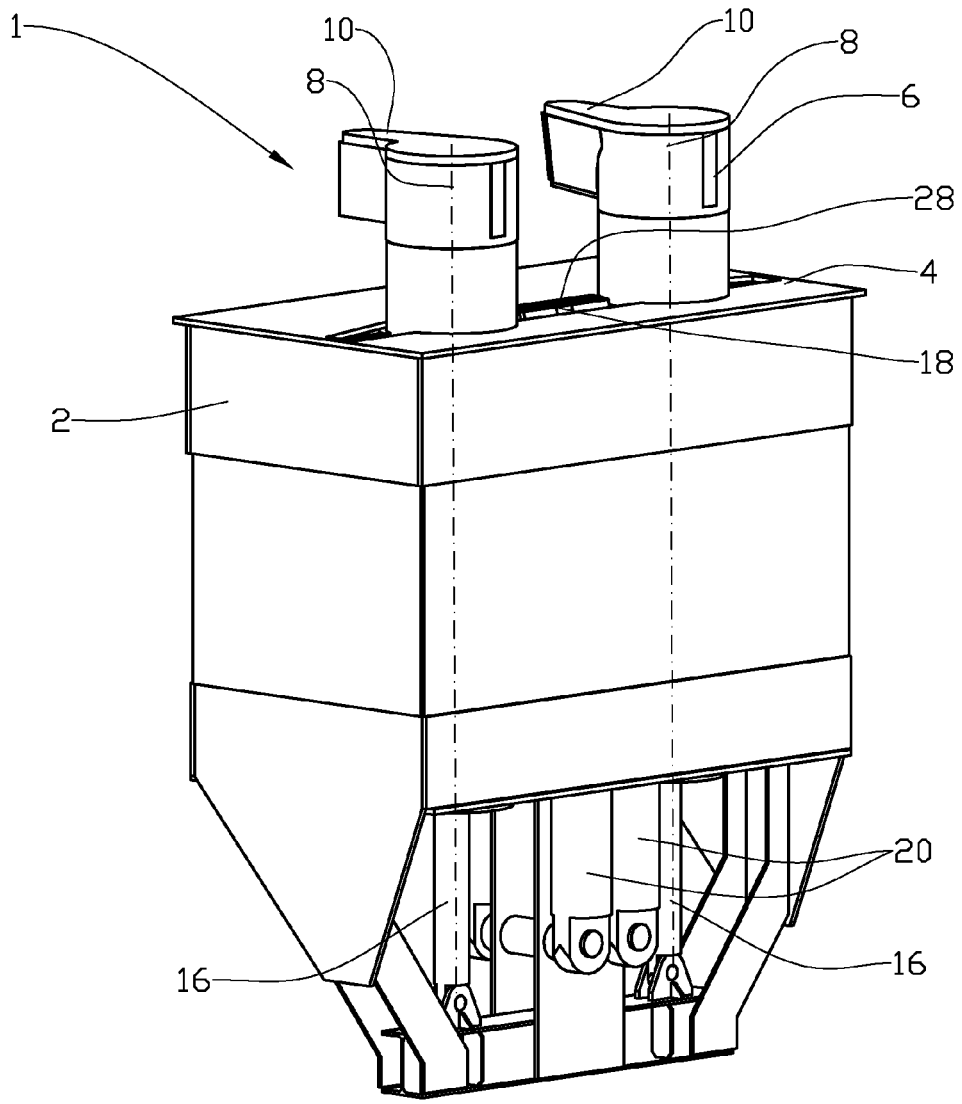
FIG. 2 shows the device in FIG. 1, but in another operational position.

Referring to FIGS. 1 and 2, two vertically movable tow pins 6 are positioned in the cage 2 at a distance between them. Each of the tow pins 6 is pivotable about their vertical axis 8 and has a bridge part 10 extending radially from the upper portion of the tow pin 6. When turned towards each other, the two bridge parts 10 form a bridge 12 as shown in FIG. 1. The tow pins 6 are equipped with a rotation stopper 14 as shown in FIGS. 3 and 4, and are individually moved by pin actuators 16.

A vertically movable lower stopper 18 is positioned in the cage 2 between the tow pins 6. The lower stopper 18 is, in one embodiment, actuated by four lower stopper actuators 20.

Both the tow pins 6 and the lower stopper 18 are located by relatively low friction guides, not shown, in the cage 2.

Figure 3:
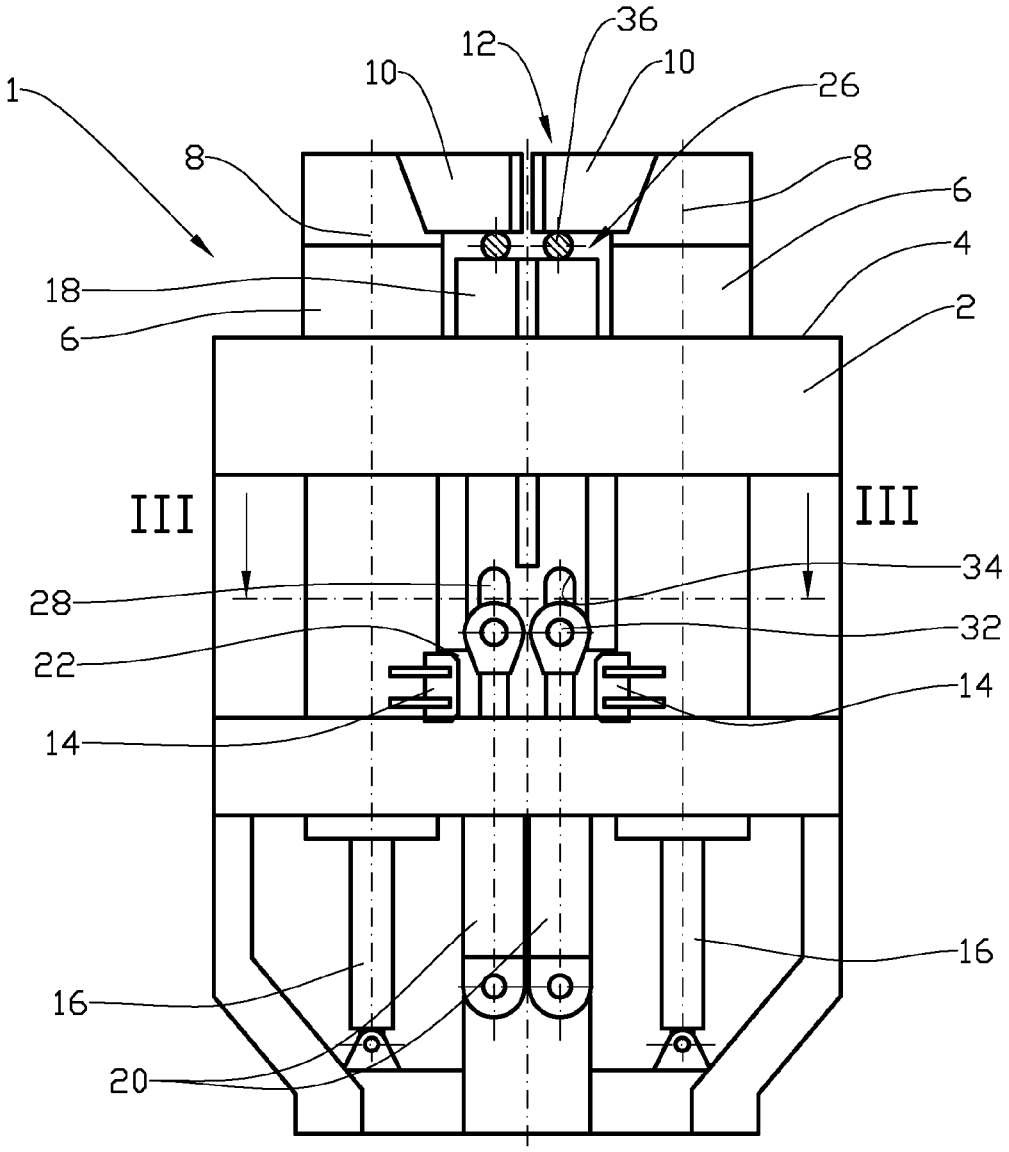
FIG. 3 shows a side view of the device in FIG. 1 but with a wall plate removed.
Figure 4:
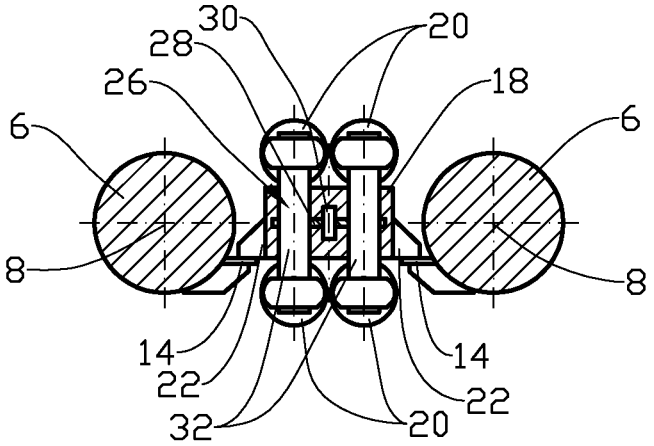
FIG. 4 shows a section III-III of the device in FIG. 3.

Referring to FIG. 3, the lower stopper 18 has on each side facing the tow pins 6, a protrusion 22 that limits the rotation stopper 14. When the vertical position of a rotation stopper 14 and a protrusion 22 coincide, the tow pin 6 is prevented from further rotation in the pull direction of a tow line 24.

Figure 6:
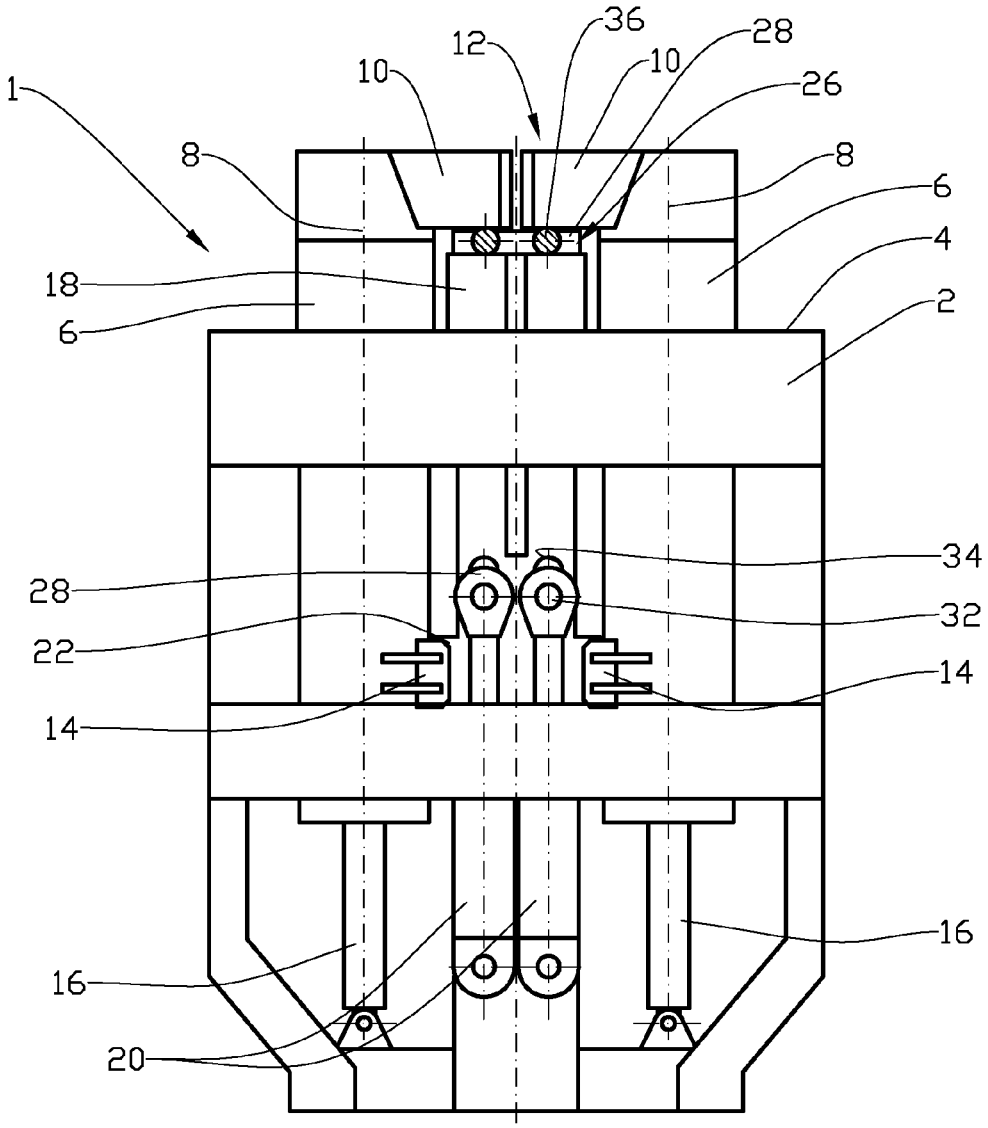
FIG. 6 shows the same view as in FIG. 3 but with the device in a cutting position.

A cutter 26 as shown in FIGS. 4 and 6 is provided in the lower stopper 18. In one embodiment the cutter 26 includes a blade formed knife 28 that is vertically movable within the lower stopper 18. In its passive position the knife 28 is fixed to the lower stopper 18 by a shear pin 30 as shown in FIG. 4.

Referring to FIGS. 3 and 6, an actuator pin 32 extends between a pair of the lower stopper actuators 20, through the knife 28 and through elongated openings 34 in the lower stopper 18. The force set up by the lower stopper actuators 20 is directed to the knife 28 via the actuator pins 32. When the knife 28 is in its passive position, the force from the lower stopper actuators 20 is transferred to the lower stopper 18 via the shear pin 30 (FIG. 4).

All actuators 16, 20, that are pivotably fixed to the cage 2, are in one embodiment hydraulically activated.

FIGS. 1 and 3 show the tow line controlling device 1 in a position with a locked tow line 24. A horizontal link 36 is positioned between the bridge 12 and the lower stopper 18.

The lower stopper 18, the two tow pins 6, and the bridge 12 surround the horizontal link 36 of the tow line 24. A vertical link 38 of the tow line 24 abuts the bridge 12 and the lower stopper 18, the lower stopper 18 being in one active position, and prevents the tow line 24 from moving in the pull direction of the tow line 24. In this position the rotation stoppers 14 engage with the protrusions 22. The lower stopper 18 may be positioned into several active positions according to different dimensions of the horizontal link 36.

Figure 5:
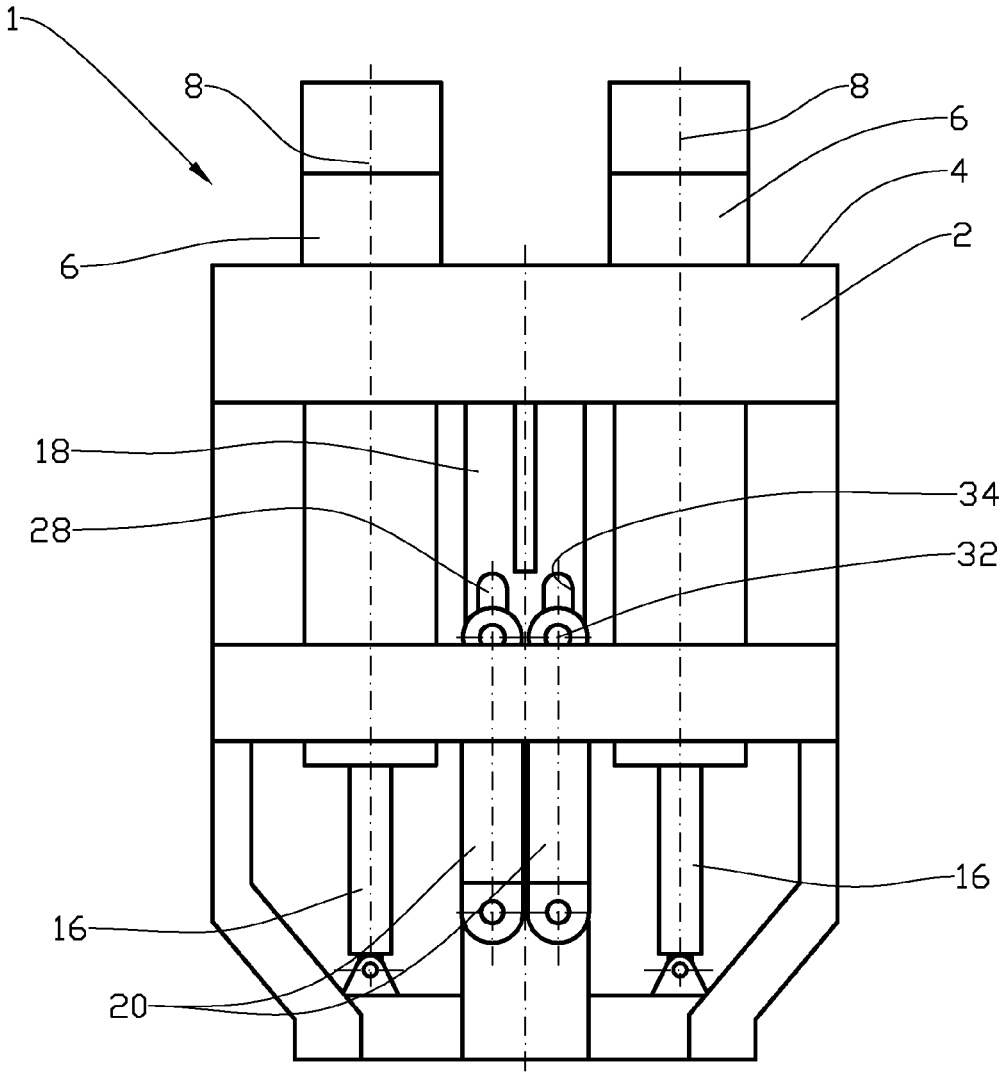
FIG. 5 shows the same view as in FIG. 3 but with the device in the operational position shown in FIG. 2.

In FIGS. 2 and 5 the tow line controlling device 1 is shown in a released position where the lower stopper 18 has been moved downwards relative the position shown in FIG. 1. The protrusions 22 are thus moved out of engagement with the rotation stoppers 14 and the tow pins 6 are turned, thereby moving the bridge parts 10 out of engagement with the tow line 24.

If an emergency cut off of the tow line 6 is to be performed, the force from the lower stopper actuators 20 is increased to break the shear pin 30. The knife 28 is then free to move relatively the lower stopper 18. The knife 28 is moved upwards and into the tow line 24 cutting the tow line 24 as the actuator pins 32 move in the elongate openings 34 of the lower stopper 18, see FIG. 6.

Figure 7:
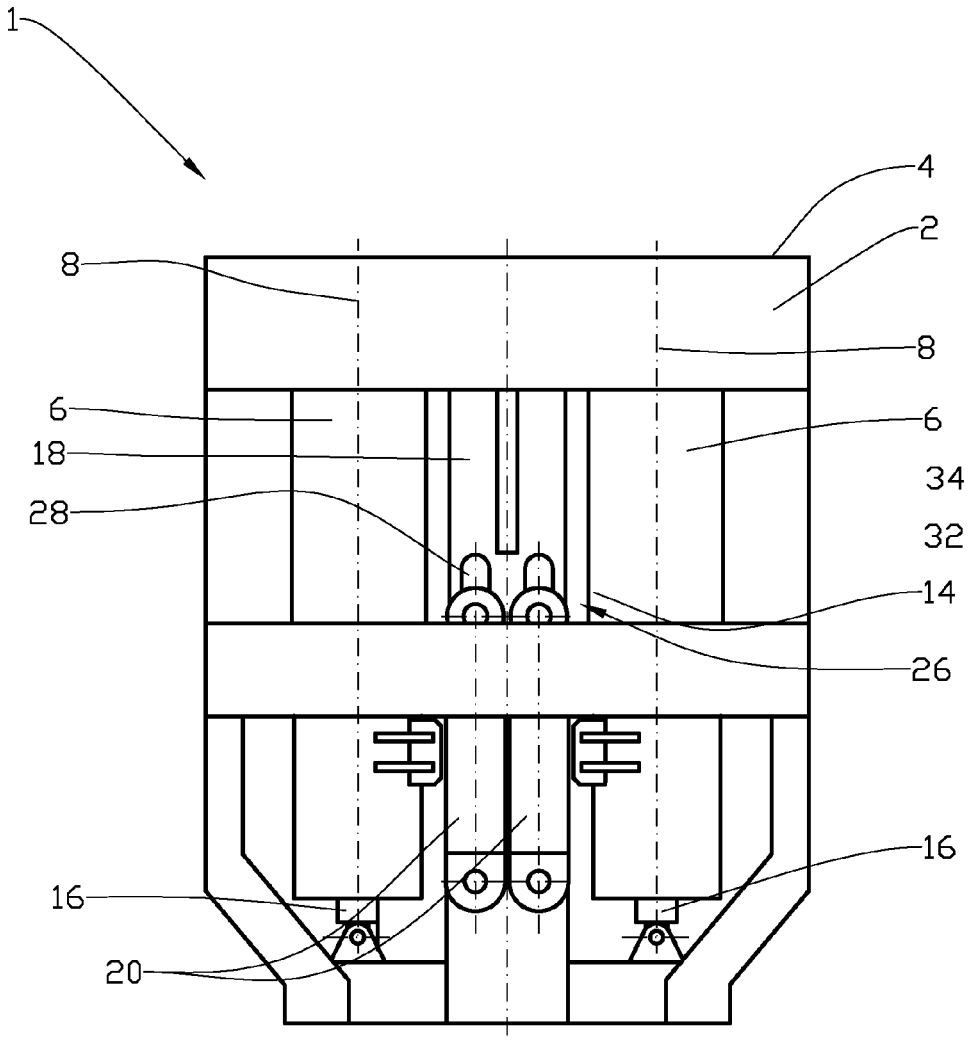
FIG. 7 shows the same view as in FIG. 3 but with the device in a passive operational position.
Figure 8:
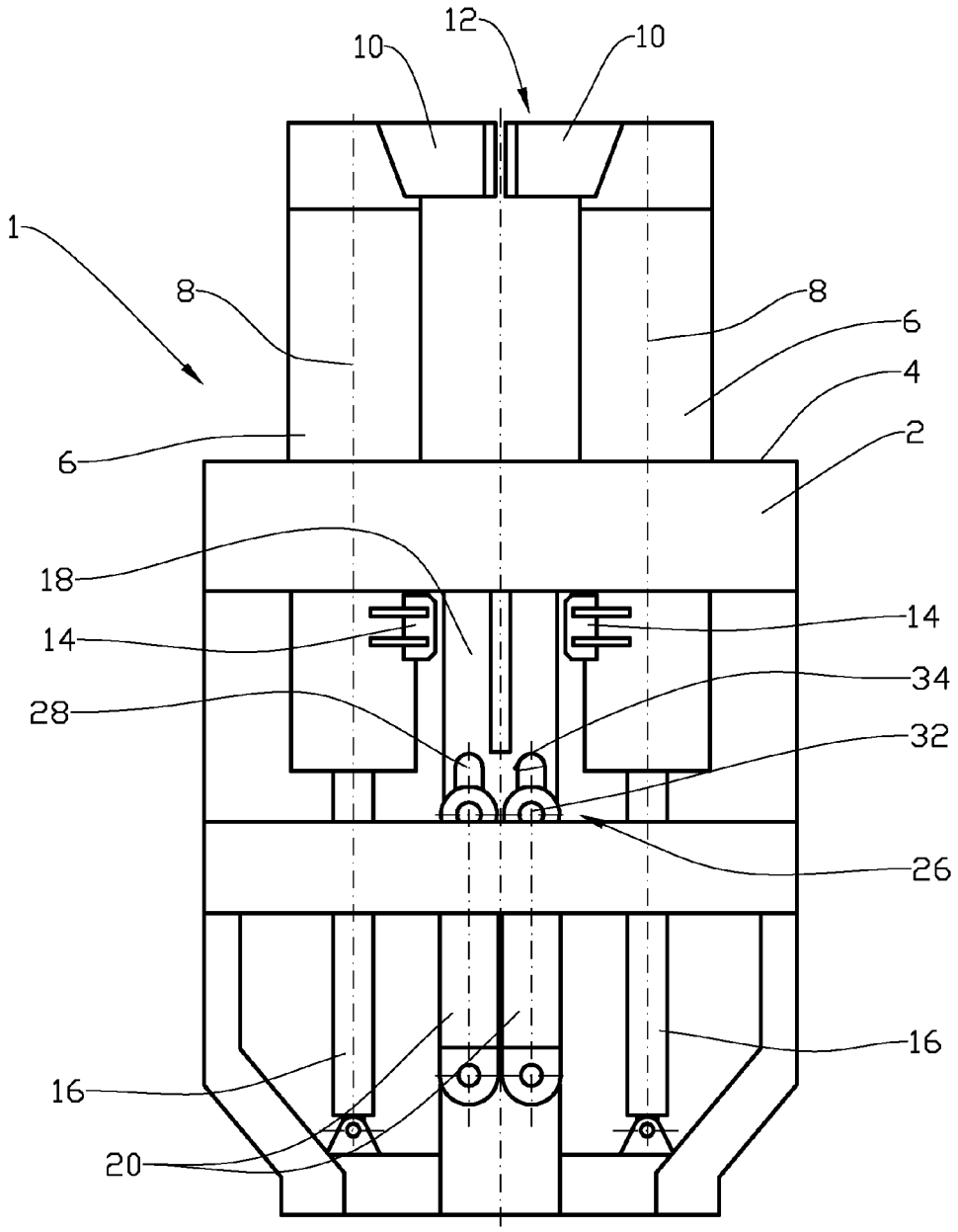
FIG. 8 shows the view same as in FIG. 3 but with the device in a guiding position.

The tow pins 6 and the lower stopper 18 may be retracted into the deck 4 to a passive position as shown in FIG. 7. The tow pins 6 may be fully erected as shown in FIG. 8. This position is mainly used for steering the tow line 24.

Thus, in an exemplary embodiment, there is provided a tow line controlling device that is positioned in a deck of a vessel, and the tow line controlling device includes at least two tow pins that are movable between a passive position and at least one active position, and wherein a gap between two of the tow pins is spanned by a bridge at least when the tow pins are in one of their active positions. A lower stopper is positioned between two of the tow pins and is movable between a passive position and at least one active position.

The device including the towing pin and the lower stopper may be produced as a preassembled unit within a cage that is intended to be positioned in a deck of the actual vessel to be towed. In some embodiments, the disclosed functions may be present also when the various items are positioned in the same relative positions but separately built into the hull of the ship.

The position of the lower stopper in the space between two tow pins gives the device features that are previously unknown for such devices, as discussed below.

The lower stopper, the two tow pins, and the bridge may surround a tow line, preferably as a closed-opening. The tow line is thus held in one position relative the deck, and tow line letting out and pulling in operations may be carried out safely even in heavy seas.

In one of the active positions, the tow line may be held between the lower stopper and the bridge. A portion of the tow line, typically a horizontal link, may be clamped or just be positioned so that the next vertical link may bear on the lower stopper and the bridge.

A cutter may be operable on the tow line when the tow line is held between the lower stopper and the bridge. The cutter may include a knife that is operable with the lower stopper. When the knife is inactive, it may follow the movement of the lower stopper.

In one embodiment the cutter has the form of a knife blade that is included in the lower stopper. When inoperative, the knife blade moves with the lower stopper as it is kept in position by a shear pin.

When the tow line is to be cut, the lower stopper forces the tow line towards the bridge. As the force is increased, the shear pin shears, where after the knife moves out from the lower stopper and cuts the tow line.

The knife may be operated by a lower stopper actuator that also operates the lower stopper.

The bridge may include more than one bridge part where each of bridge part is fixed to one tow pin. In some embodiments the bridge is divided in two equal parts, each fixed to one tow pin. The tow pins are rotatable about a vertical axis, and the bridge part may be turned out of the way, for instance when the tow line is to be positioned between the tow pins.

The tow pin may have a rotational stopper that in its active position bears against the lower stopper.

In accordance with principles described herein, there is provided a method for operation of a tow line controlling device that is positioned in a deck of a vessel. In various embodiments, the tow line controlling device includes at least two tow pins that are movable between a passive position and at least one active position, and wherein a gap between two of the tow pins is spanned by a bridge at least when the tow pins are in one of their active positions. In some embodiments, method includes positioning a lower stopper, that is movable between a passive position and at least one active position, between two of the tow pins.

The method may further include surrounding a tow line with the lower stopper, the two tow pins, and the bridge.

The method may further include holding the tow line between the lower stopper and the bridge when the tow pins are in one of the active positions.

The method may further include operating a cutter on the tow line when the tow line is held between the lower stopper and the bridge.

The method may further include letting the cutter include a knife that is included in the lower stopper.

The method may further include that the knife when inactive, follows the movement of the lower stopper.

The method may further include operating the knife by use of a lower stopper actuator.

The method may further include letting the bridge include more than one bridge part where each bridge part is fixed to one tow pin.

The tow pins may have machinery that is designed to turn the tow pins about their longitudinal axis. Both the tow pins and the lower stopper may have locks that are intended to lock the respective items to the cage. As these items are known to a skilled person they are not further discussed.

A difference from conventional chain stopping devices is that the disclosed device is configured to surround and sometimes grasp a horizontal link of the tow chain. Thereby, the disclosed device is configured to abut and stop a vertically standing link instead of stopping a horizontal link of a chain. This feature is beneficial to the capability of cutting the tow line. The disclosed design is believed to provide a more controlled emergency release.

There is thus provided a device where the lower stopper and tow pins are generally mounted and configured to move in a plane that is perpendicular to the general length axis of the tow line, and where they interact and use each other for various reasons. The benefits over conventional devices are, for example:

Better emergency release capability.

Greater overall safety, the tow line is locked in a closed-opening and no inserts are needed for switching between different chain sizes, shackles or sockets.

Possibility to cut and release the tow line while the tow chain is in the closed-opening of the device.

The invention claimed is:

1. A tow line controlling device adapted to be positioned in a deck of a vessel and connected to a tow line, the tow line controlling device comprising:

two or more tow pins movable between a passive position and at least one active position, wherein a gap between two of the tow pins is spanned by a bridge configured to hold a tow line at least when the tow pins are in one of their active positions, and a lower stopper movable between a passive position and at least one active position, the lower stopper being disposed between two of the tow pins, wherein the lower stopper and the two tow pins are generally mounted in a plane perpendicular to the general length axis of a tow line to be guided therebetween.

2. The device according to claim 1, wherein the lower stopper, the two tow pins, and the bridge are adapted to surround the tow line.

3. The device according to claim 1, wherein the device is configured to hold the tow line between the lower stopper and the bridge when the lower stopper is in at least one of its active positions and the tow pins are in at least one of their active positions.

4. The device according to claim 3, wherein a cutter is operable on the tow line when the tow line is held between the lower stopper and the bridge.

5. The device according to claim 4, wherein the cutter includes a knife that is operable with the lower stopper.

6. The device according to claim 5, wherein the knife is configured to follow the movement of the lower stopper when the knife is inactive.

7. The device according to claim 5, further comprising a lower stopper actuator configured to operate the lower stopper, wherein the knife is operated by the lower stopper actuator.

8. The device according to claim 1, wherein the bridge includes more than one bridge part, and wherein each bridge part is fixed to one tow pin.

9. The device according to claim 1 wherein the lower stopper and the bridge are configured to abut a vertical link of the tow line.

10. A method for operating a tow line controlling device adapted to be positioned in a deck of a vessel, the tow line controlling device comprising two or more tow pins movable between a passive position and at least one active position, wherein a gap between two of the tow pins is spanned by a bridge at least when the tow pins are in one of their active positions, the method comprising:

positioning a lower stopper, movable between a passive position and at least one active position, between two of the tow pins, wherein the lower stopper and the tow pins are generally mounted in a plane perpendicular to the general length axis of a tow line adapted to be guided therebetween.

11. The method according to claim 10 further comprising: surrounding a link of a tow line with the lower stopper, the two tow pins and the bridge.

12. The method according to claim 10 further comprising: holding a link of a tow line between the lower stopper and the bridge when the tow pins are in one of the active positions.

13. The method according to claim 12 further comprising: operating a cutter on the tow line when the tow line is held between the lower stopper and the bridge.

14. The method according to claim 13 further comprising: letting the cutter include a knife that is disposed in the lower stopper.

15. The method according to claim 14 further comprising: letting the knife when inactive, follow the movement of the lower stopper.

16. The method according to claim 14 further comprising g operating the knife by use of a lower stopper actuator.

17. The method according to claim 10 wherein the bridge includes more than one bridge part, and each bridge part is fixed to a tow pin.

18. A tow line controlling device for mounting on a marine vessel and connecting to a tow line, the device comprising:

a first tow pin having a first central axis disposed in a plane, a second tow pin comprising a second central axis that intersects the plane, a gap disposed between the two tow pins and disposed in the plane, a bridge configured to extend between the two tow pins, a lower stopper disposed in the plane and configured for movement within the gap, wherein the gap is adapted to receive a tow line between the two tow pins and the lower stopper.

19. The device of claim 18 wherein the two tow pins, the bridge, and the lower stopper are configured to close the opening and to surround a first link of a tow line, wherein the bridge and the lower stopper are configured to grasp the first link and to abut a second link to resist movement of the tow line.

20. The device of claim 19 wherein bridge and the lower stopper are configured to clamp the first link.

21. The device of claim 19 wherein the axes of the two tow pins extend vertically;

wherein the lower stopper is configured to move vertically, wherein the first link is a horizontal link and the second link is a vertical link.

22. The device of claim 18 wherein the axes of the two tow pins are parallel, and the plane is perpendicular to a general length axis of the tow line.

23. The device of claim 22 wherein each tow pin comprises a cylindrical body and a bridge part extending radially from the cylindrical body, wherein each tow pin has a first active position in which the bridge part is disposed in the plane and a second active position in which the bridge part is rotationally displaced from the plane, wherein the bridge is formed by the two bridge parts of the two tow pins at least when the two tow pins are in their first active position, spanning the gap and configuring the gap to be closed.

24. The device of claim 23 wherein the lower stopper has a passive position and an active position, wherein the two tow pins, the bridge, and the lower stopper are configured to surround and are configured to clamp a link of a tow line when the two tow pins are in their first active position and the lower stopper is in its active position.

25. The device of claim 24 wherein the two tow pins and their bridge parts are configured to be disposed below the deck of a vessel when in a passive position, wherein the lower stopper is configured to be disposed below the deck of a vessel when in its passive position.

26. The device of claim 18 further comprising:

a lower stopper actuator configured to operate the lower stopper, a cutter having a knife disposed within the lower stopper, wherein the knife is configured to be operated by the lower stopper actuator for a first mode of operation in which the knife passively follows the movements of the lower stopper and for a second mode of operation in which the knife moves relative the lower stopper, wherein the knife is configured to cut a link of the tow line in the second mode of operation.

27. The method according to claim 12 further comprising: moving the lower stopper and the bridge closer together.

* * * * *